US008884552B2

(12) United States Patent
van Doorne et al.

(10) Patent No.: US 8,884,552 B2
(45) Date of Patent: Nov. 11, 2014

(54) ILLUMINATION SYSTEM COMPRISING A LIGHT SOURCE AND A CONTROL UNIT AND AN ILLUMINATION CONTROL SYSTEM FOR CONTROLLING A LIGHT SOURCE BY MULTIPLE USER INTERFACE SURFACES

(75) Inventors: Hubert Johan Marie Robert van Doorne, Waalre (NL); Petrus Johannes Maria Welten, Oss (NL)

(73) Assignee: Eldolab Holding B.V., Eindhoven (NL)

( * ) Notice: Subject to any disclaimer, the term of this patent is extended or adjusted under 35 U.S.C. 154(b) by 1123 days.

(21) Appl. No.: 12/867,334

(22) PCT Filed: Feb. 13, 2009

(86) PCT No.: PCT/NL2009/000031

§ 371 (c)(1),
(2), (4) Date: Nov. 2, 2010

(87) PCT Pub. No.: WO2009/102195

PCT Pub. Date: Aug. 20, 2009

(65) Prior Publication Data

US 2011/0050113 A1 Mar. 3, 2011

(30) Foreign Application Priority Data

Feb. 15, 2008 (WO) ..... PCT/NL2008/000044

(51) Int. Cl.
*H05B 37/02* (2006.01)

(52) U.S. Cl.
CPC ..... *H05B 37/0209* (2013.01); *H05B 37/0254* (2013.01)
USPC ..... 315/307; 315/291; 315/294; 315/297; 315/308; 315/312

(58) Field of Classification Search
CPC ..... H05B 37/00; H05B 37/02
USPC ..... 315/291, 294, 297, 307, 308, 312
See application file for complete search history.

(56) References Cited

U.S. PATENT DOCUMENTS

| | | | | |
|---|---|---|---|---|
| 6,630,800 | B2 * | 10/2003 | Weng | 315/291 |
| 2007/0132405 | A1 | 6/2007 | Hillis et al. | |

FOREIGN PATENT DOCUMENTS

| | | | |
|---|---|---|---|
| DE | 2006 006 509 | U1 | 8/2007 |
| GB | 2 148 629 | A | 5/1985 |
| GB | 2 421 366 | A | 6/2006 |
| WO | 91/12599 | A1 | 8/1991 |
| WO | 2006/054263 | A1 | 5/2006 |
| WO | 2006/107199 | A2 | 10/2006 |

* cited by examiner

*Primary Examiner* — Tung X Le
*Assistant Examiner* — Jonathan Cooper
(74) *Attorney, Agent, or Firm* — Hoffmann & Baron, LLP

(57) ABSTRACT

An Illumination system comprising a light source (1010) and a control unit (CU1) for controlling the light source is described. The control unit is arranged to operate in a first state to control a first illumination parameter of the light source and in a second state to control a second illumination parameter, a transition from the first state to the second state is obtained by providing a pulling force to a control element of the control unit.

17 Claims, 5 Drawing Sheets

PRIOR ART

ILLUMINATION SYSTEM COMPRISING A LIGHT SOURCE AND A CONTROL UNIT AND AN ILLUMINATION CONTROL SYSTEM FOR CONTROLLING A LIGHT SOURCE BY MULTIPLE USER INTERFACE SURFACES

CROSS-REFERENCE TO RELATED APPLICATIONS

This application is the National Stage of International Application No. PCT/NL2009/000031, filed Feb. 13, 2009, which claims the benefit of International Application No. PCT/NL2008/000044, filed Feb. 15, 2008, the contents of which is incorporated by reference herein.

FIELD OF THE INVENTION

Illumination systems comprising a control unit for controlling a light source such as switches or dimmers are known. They are widely applied to control an illumination parameter of the light source such as the intensity of the light source. The light source can e.g. be a light bulb or a halogen lamp.

BACKGROUND OF THE INVENTION

In a known arrangement, such a control unit comprises a control element such as a knob or a selector for changing the intensity of the light source. In general, a displacement of the control element can be converted by the control unit into a control signal for controlling the illumination parameter. Such a conversion can e.g. be accomplished by applying a transducer in the control unit. As an example, such a transducer can be a potentiometer or a rotary encoder. By operating the knob or selector, a characteristic of the transducer can be modified and in response to this modified characteristic, the control unit can e.g. generate a control signal to change the intensity of the light source. Often, the functionality of changing the intensity of the light source is combined with a further functionality of turning the light source on or off. This additional functionality can e.g. be realised by a separate switch mounted to the control unit, mounted adjacent to the knob or selector, or the on/off switching can be realised by pushing the knob or selector rather than rotating the knob. Alternatively, the on/off switching of the light source can be realised by a particular position of the selector or knob.

The above described conventional control unit is at present widely distributed and most people are familiar with the operation of such a control unit.

Recently, new light sources for e.g. domestic lighting applications have been developed that provide additional features or controllable parameters compared to a conventional light bulb. Whereas a conventional light bulb only allows the intensity of the light source to be controlled, more recent light sources such as LED fixtures allow the colour of the light source to be controlled as well. As an example, such a LED fixture can comprise a set of LEDs of different colour that can be operated at a different duty cycle or intensity, thereby allowing the colour of the light source as a whole, i.e. as observed by a person, to be modified. As an example on how both a colour and an intensity of a LED fixture can be controlled, reference can be made to WO 2006/107199, incorporated herein by reference. A further example of an illumination parameter that may be controlled is the direction of a light beam of the light source. To that extent, light sources can be equipped with e.g. an electric motor or actuator for displacing or positioning the light source or a part thereof. In order to anticipate on such additional features, control units for controlling such light sources are required. One way of incorporating an additional functionality, such as enabling the colour of a light source to be modified in addition to the intensity being modified, is to provide additional knobs or selectors on the control unit for addressing the different functionalities or illumination parameters. A drawback of such an arrangement is that, in general, the control unit will become larger, require more components and will be more expensive. A further drawback of such an arrangement is that the use of such a control becomes more complex, in particular to an inexperienced user. This can be illustrated as follows: In case the control unit comprises different knobs or selectors for addressing the different functionalities (e.g. a first knob for turning the light source on/off and changing the intensity and a second knob for changing the colour), the user needs to select the appropriate knob for obtaining the required functionality. This may be cumbersome in e.g. domestic applications where, in general, the control of the light source will be directed most of the time to changing the intensity rather than the colour. As an alternative to a control unit with multiple knobs or selectors, one might also consider adding a control layer to the control unit. In such an arrangement, the control unit may e.g. comprise a single knob or selector combined with a switch to change an operating mode of the control unit. Depending on the position of the switch, the displacement of the knob (e.g. a rotation) may result in a change in intensity of the light source or in a change of colour of the light source. A drawback of such an arrangement is that a user who is using the control unit for the first time or for the first time in a long time may find the control unit in a different mode than expected or may be confused when inadvertently operating the switch, thereby obtaining an unexpected operating mode.

In view of the above mentioned recent developments with regard to light sources, it may further be preferred to control such light sources from different locations or using different control units or consoles. In general, it is known to provide an illumination system comprising one or more light sources with multiple control units for controlling the light source (or light sources). As an example, a light source, such as a light bulb, can be controlled (e.g. turned on or off) by different control units (or consoles) from different locations. Such a lighting control system may also comprise more sophisticated control units such as a remote control. Such remote controls can e.g. apply an RF signal to control the light source. As mentioned above, a control unit can be applied to control various parameters of a light source including e.g. the intensity, the colour or an orientation or direction of the light source. Often, a control of these parameters is preferably done from various locations requiring more than one control unit. Known illumination systems having multiple control units are organised using a master-slave concept wherein one control unit operates as the master, the other control units operate as slave. In such a configuration, the flexibility to vary different parameters of the illumination system may be limited, or in order to obtain the required flexibility, complicated control schemes or a substantial configuration effort are required.

SUMMARY OF THE INVENTION

In view of the above mentioned drawbacks, it is a first object of the present invention to provide an illumination system comprising a light source and a control unit for controlling the light source, the control unit incorporating an increased functionality, substantially without disrupting the conventional way of operating the control unit.

It is a further object of the invention to provide an illumination control system that provides a flexible light source control using multiple control units and which is easier to configure.

According to an aspect of the invention, there is provided an Illumination system comprising a light source and a control unit for controlling the light source, wherein the control unit is arranged to operate in a first state to control a first illumination parameter of the light source and in a second state to control a second illumination parameter, the control unit comprising a control element having a displacement range, a displacement of the control element along the displacement range resulting in a change in a characteristic of the control unit, the control unit further being arranged to provide a first output signal based upon the characteristic for changing a first illumination parameter of the light source when operating in the first state and is arranged to provide a second output signal based upon the characteristic for changing a second illumination parameter of the light source when operating in the second state, characterised in that the control unit is further arranged to, in use, transition from operating in the first state to operating in the second state when a pulling force is exerted on the control element.

In the illumination system according to the invention, a further mode of operation of the control unit can be enabled by exerting a pulling force on the control element thereby enabling a change in the operating state of the control unit such that a further functionality or parameter of the light source can be addressed. When the control element is operating in the first state, the operation of the control unit may correspond to the conventional operation of the control unit, i.e. providing in a way to control a first illumination parameter of the light source (e.g. the intensity of the light source), optionally including an on/off operation of the light source. As such, when the control unit operates in the first state, an inexperienced user can operate the control unit in the same manner as a conventional control unit. On the other hand, a more experienced user who knows the further functionality of the control unit (i.e. the operation in the second state) may, when required, operate the control unit in this second state, thereby modifying a second illumination parameter of the light source (e.g. the colour of the light source). In order to transition from operating in the first state to operating in the second state, a pulling force should be applied to the control element. In a conventional control unit, on/off switching of the light source can e.g. be achieved by pushing the control element inwards e.g. with or without a spring-action to automatically return to the neutral position, or by operating a separate switch. As such, exerting a pulling force on the control element would be counterintuitive for a user of the conventional control unit. Therefore, he would not inadvertently address the further functionality of e.g. changing the colour when merely a change in intensity is required.

It is noted that the characteristic of the control unit that is referred to can be any property of physical parameter of the control unit that can change in accordance with a displacement of the control element and can therefore be applied to generate a control signal for controlling any illumination parameter of the light source.

In an embodiment of the illumination system according to the present invention, the control unit is arranged to receive an output signal of a sensor to, in use, transition from operating in the first state to operating in the second state, the sensor being arranged to detect the pulling force or a displacement of the control element due to the pulling force. By detecting the pulling force (e.g. by a force sensor) or a displacement of the control element due to the pulling force (e.g. by a position sensor), the sensor may trigger the control unit from operating in the first state to operating in the second state. Once in the second state, a displacement of the control element along the displacement range can be considered by the control unit to change the second illumination parameter (e.g. the colour of the light source) by generating an output control signal to this end.

In another embodiment, the control element is, in use, moved from a first position to a second position by the pulling force, the control unit being arranged to operate in the first state when the control element is in the first position, and arranged to operate in the second state when the control element is in the second position. In such an embodiment, the transition from the first state to the second state is obtained by repositioning the control element to a different position, a more outward position. As mentioned above, such a repositioning of the control element to a more outward position would be counterintuitive to a user who is only acquainted with a conventional control unit. As such, an unexpected operating in the second state by the inexperienced used can be avoided.

In a further embodiment, the control unit comprises means for reversing the outward displacement when, in use, the pulling force is no longer applied. In such an embodiment, the control element can, upon release, return to the first position. This may, either instantaneously or after a certain time period has lapsed, result in the control unit operating in the first state again. In such an embodiment, an automatic return to the operation of the control unit in the first state (enabling the control of the first illumination parameter of the light source) can be established.

According to another aspect of the invention, there is provided an illumination control system comprising a light source and a first and second control unit for controlling an illumination parameter of the light source, each control unit being arranged to, when in a first operating mode,

- generate a light source control signal,
- provide the light source control signal to the light source,
- provide the light source control signal to the other of the first and second control unit, each control unit further being arranged to, when in a second operating mode,
- receive and store the light source control signal generated by the other of the first and second control unit,
- each control unit further being arranged to, upon application of a user action to the control unit,
- resume or start to operate in the first operating mode,
- provide a request to the other of the first and second control unit to operate in the second operating mode.

In an illumination control system according to the present invention, each of the first and second control unit is arranged to, depending on the input of the user of the system, act either as a master (corresponding to the first operating mode), thereby controlling the light source and informing the other control unit to operate as a slave (corresponding to the second operating mode). In the illumination control system according to the present invention, an input by the user determines which control unit obtains the master-role, whereupon the assigned master control unit provides a request to the other control unit (or units), requesting the other control unit to set or resets its status to the second operating mode. By enabling the master-role to be handed over to a further control unit rather than providing a central control unit with the master-role, the configuration of the control system is simplified. Compared to a conventional master-slave system with one master control unit that is continuously in control, there is no requirement to configure the central master control unit or to reconfigure it each time a control unit is added to the control system.

In the illumination control system according to the present invention, each control unit which acts as slave (i.e. operates in the second operating mode) receives the light source control signal from the control unit that is in the first operating mode (i.e. the control unit that operates as master). As a consequence, when a control unit is triggered to switch from the second operating mode to the first operating mode, this control unit can instantaneously take over the control of the light source by using the latest control signal that was sent to the light source, as this signal was also received by the control unit. As, in a control system according to the present invention, the control possibilities of each control unit are only limited by the functionality incorporated in the control unit itself rather than being determined by the central master control unit, an increased flexibility is obtained and an improved user control capability. To illustrate this, a conventional master-slave control system may e.g. provide a dimmer functionality (i.e. enable the intensity of the light source to be modified) only when the fixed master control unit is operated, i.e. not when another control unit of the system is used, whereas in a control system according to the present invention, each control unit can obtain the master role and can be arranged to control each illumination parameter.

In a preferred embodiment of the illumination control system, the light source control signal is substantially continuously provided to the light source. Such a control system may advantageously be applied to e.g. control a LED fixture comprising one or more LEDs.

Alternatively, the light source control signal can be provided to the light source only when a change in the illumination parameters is required. In such an arrangement, the light source may comprise a controller to store the light source control signal and apply the light source control signal to control the light source until a further light source control signal is received.

In an embodiment, one of the first and second control unit is arranged to, upon receipt of a sensor signal,

- resume or start to operate in the first operating mode,
- provide a signal or a request to the other of the first and second control unit to operate in the second operating mode,
- generate the light source control signal based on the sensor signal,
- provide the light source control signal to the light source.

In such an embodiment, a sensor signal can be received by one of the control units and trigger the control unit to operate in the first operating mode (i.e. as master). A sensor signal in general indicates the occurrence of an event. Such an event can be a user action or can be the occurrence of a change in environmental conditions. As such, the sensor signal can e.g. originate from an alarm, such as a fire alarm which can be automatically triggered (e.g. via a smoke detector) or which can be manually triggered by a user. In the embodiment of the illumination control signal according to the invention, the sensor signal is received by at least one of the control units. This can be realised in various ways:

In an embodiment, the sensor signal is received by only one of the control units. Phrased differently, one could say that the sensor providing the sensor signal and the control unit receiving the signal are paired or form a pair. Prior to the receipt of the control signal, the control unit that forms a pair with the sensor, can either operate in the first operating mode or the second operating mode (depending on its current role). Upon receipt of the sensor signal, the control unit that is paired with the sensor can then resume or start to operate in the first operating mode, thereby obtaining or continuing the master-role. Further, in response to the receipt of the sensor signal, the control unit can provide a signal or a request to the other of the first and second control unit to operate in the second operating mode.

The control unit receiving the sensor signal may then generate a light source control signal based on the sensor signal. In case the sensor signal represents the occurrence of an emergency, the light source control signal can e.g. be arranged to power the light source (or all light sources that are controlled) at a predetermined level (e.g. 100%).

Instead of pairing a sensor to one of the control unit, all control units of the lighting control system can be arranged to receive the sensor signal. In such an arrangement, the control units can be arranged to respond to the sensor signal only when they operate in the first operating mode. By doing so, only the control unit having the master role needs to generate the light source control signal based on the sensor signal. Note that in such an arrangement, there is no need for the control unit receiving the sensor signal to provide a signal or a request to the other control units to operate in the second operating mode as there is no requirement to change the role (either master or slave) of any of the control units. In such an arrangement, the sensor signal can e.g. be provided to all control units via a communication interface connecting the control units. Such a communication interface can e.g. comprise a common bus system e.g. an RS485 bus system. The communication interface may also comprise a power line communication (PLC) system or can be a wireless communication interface. Also, the In an embodiment, the control units of the lighting control system can be arranged to assign a higher priority to providing a response to a sensor signal compared to providing a response to a user action to the control unit.

BRIEF DESCRIPTION OF THE DRAWINGS

Further embodiments and advantages of the present invention are described in more detail in the following figures.

DETAILED DESCRIPTION OF THE PREFERRED EMBODIMENTS

Figure 1:
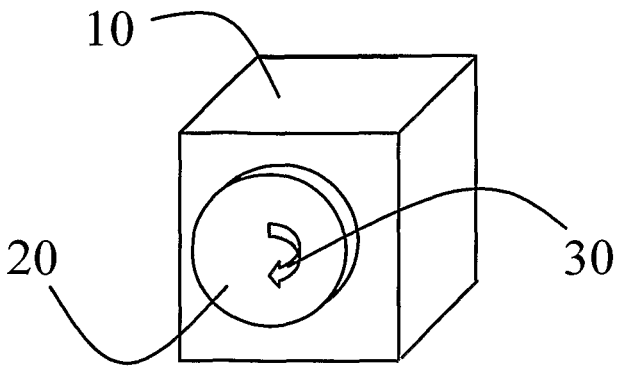
FIG. 1 schematically depicts a 3D view of a conventional control unit.

FIG. 1 schematically shows a conventional control unit 10 for a light source, the control unit comprising a control element 20. In the embodiment as shown, the control element 20 comprises a knob which can be rotated in a direction as indicated by the arrow 30. By rotating the knob, the intensity of the light source (not shown) can be modified.

Figure 2:
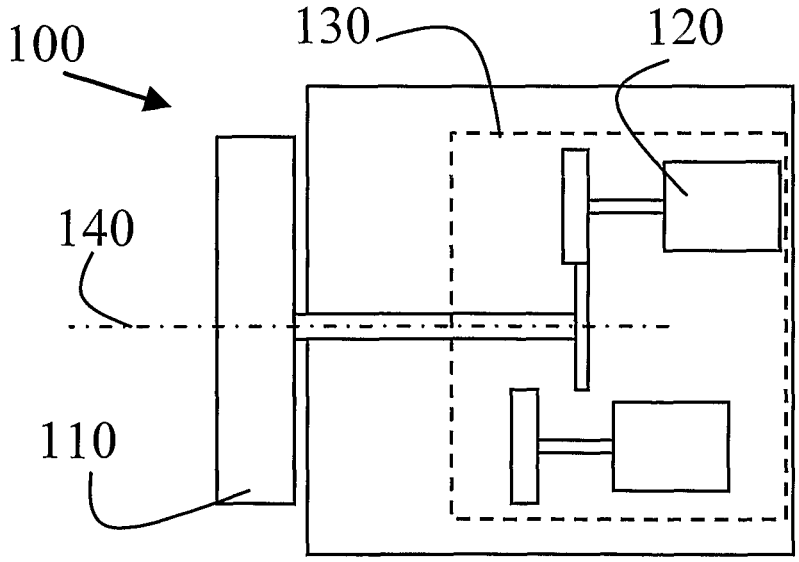
FIG. 2 schematically depicts a 2D cross-sectional view of a first control unit as can be applied in an illumination system according to the present invention.

FIG. 2 schematically shows an XY cross-sectional view of a first control unit of an illumination system according to the invention. The control unit 100 comprises a control element 110 which, in the position as shown, engages with a transducer 120 of a transducer unit 130. By operating the control element 110 (e.g. rotating the element about an axis 140), a characteristic of the transducer 120 can be modified. This changed characteristic can be applied by the control unit to generate a control signal for e.g. controlling the intensity of the light source (not shown) that is controlled by the control unit. It will be appreciated by the skilled person that various possibilities exist with respect to the characteristic of the control unit that would allow the control unit to generate the appropriate control signal. The displacement of the control element may e.g. result in a change in a resistance value of an electric component of the control unit. A transducer such as a potentiometer could be applied in this case. Another possibility would e.g. be to measure the displacement of the control element along the displacement range and generate an output signal based upon the measured displacement. As an example, a rotary encoder (e.g. optical or magnetic) comprising a grating and a sensor could be applied to measure the displacement of the control element relative to the other components of the control unit. It will be apparent that other ways can be devised by the skilled person to convert a displacement of the control element to an output signal that can be applied to control an illumination parameter of the light source.

Figure 3:
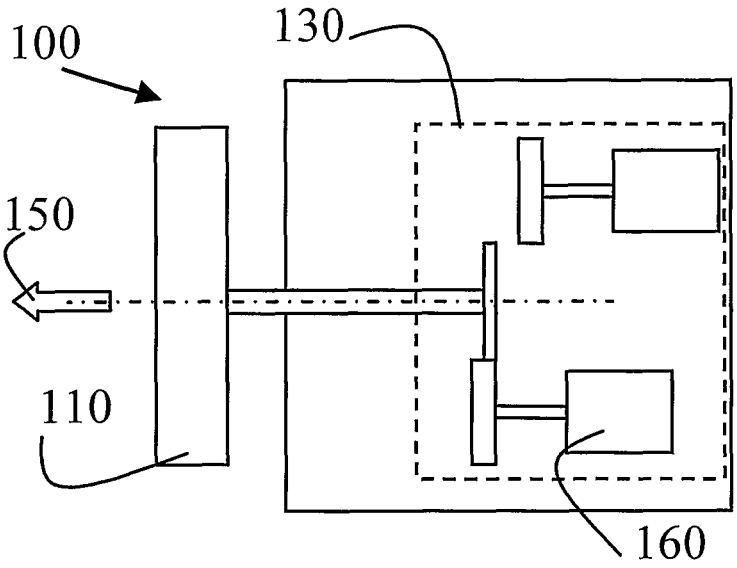
FIG. 3 schematically depicts a further 2D cross-sectional view of the first control unit in different position.

FIG. 3 schematically shows the control unit of FIG. 2, the control element 110 being in a different, more outward, position, compared to FIG. 2. As can be seen in FIG. 3, the control element 110 has been moved outwardly relative to the transducer unit 130, as indicated by the arrow 150, to a different position, compared to the position of the control element as shown in FIG. 2. This displacement can e.g. be realised by exerting a pulling force on the control element in the direction of the arrow 150. In the position as shown, the control element engages with a second transducer 160 of the transducer unit 130, thereby enabling, when the control element is operated, the modification or change in a further characteristic of the transducer unit, i.e. a characteristic of the second transducer. This changed characteristic can e.g. be applied by the control unit to generate a control signal to e.g. control the colour of the light source. In order to engage the control element 110 with the second transducer 160, the control element can be pulled outward by the user of the control unit. Compared to the conventional use of a control unit for controlling the intensity of a light source (such a control unit is also known as a dimmer), this operation is counterintuitive to the user. As a consequence, the known operation of the control unit as a dimmer remains substantially as is; the user is not confronted with additional control layers or does not have to take additional control actions to use the control unit as a dimmer in the conventional way. An advantage of the embodiment shown in FIGS. 2 and 3 is that a different value of the characteristic of the control unit can be addressed in each of the control element positions.

Figure 4:
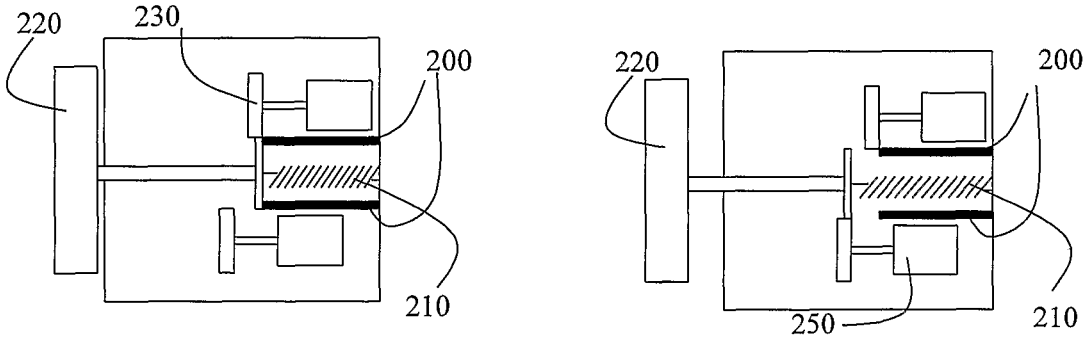
FIG. 4 schematically depicts a 2D cross-sectional view of a second control unit as can be applied in an illumination system according to the present invention.

FIG. 4 schematically depicts an embodiment of a control unit of an illumination system according to the invention comprising means for reversing the outward displacement when, in use, the pulling force is no longer applied. The left part the FIG. 4 shows the control element 220 in a position to engage with the first transducer 230. The control element 220 is maintained in that position by a spring 210 and endstops 200 disabling the control element to displace further to the right. The right part of FIG. 4 shows the control element 220 engaging with a second transducer 250. In order to operate the control element in this position, i.e. addressing the second displacement range, the user has to apply a force that counteracts the spring force. When the control element 220 is released, the element returns to the position as shown on the left. As a result, the control element 220 is again in a position to change the first illumination parameter, e.g. the intensity of the light source. It will be apparent that other means for providing a pull-back force can be devised, such as the use of permanent magnets or electromagnets. An advantage of embodiments comprising means for reversing the outward displacement when, in use, the pulling force is no longer applied is that the control unit returns to the first state upon release, thereby enabling the control of the first illumination parameter, e.g. corresponding to the conventional way of operating the control unit.

Figure 5:
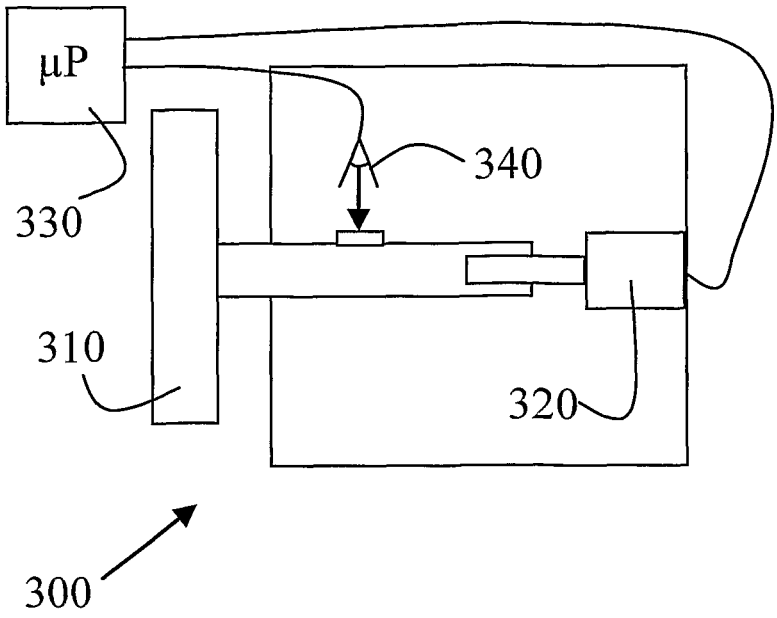
FIG. 5 schematically depicts a 2D cross-sectional view of a third control unit as can be applied in an illumination system according to the present invention.

FIG. 5 schematically shows another embodiment of a control unit 300 of the illumination system according to the present invention. Rather than engaging the control element 310 with different transducers in the first and second position, it is possible to address the control of the first and second illumination parameters using the same transducer 320. In the embodiment as shown, the transducer output (e.g. a changed electric characteristic of the transducer) is fed to a microprocessor 330 (controller). The control unit further comprises detecting means 340 for detecting the position or displacement of the control element 310. Examples of such detecting means comprise a position sensor or a velocity sensor or, in general, a detector for detecting a displacement. An output signal of these detecting means is also fed to the microprocessor. Based upon both signals, the microprocessor 330 can determine whether the transducer output should result in a control signal for controlling the first illumination parameter, e.g. the intensity of the light source or whether the signal should result in a change a second illumination parameter, e.g. a change of colour.

Figure 6:
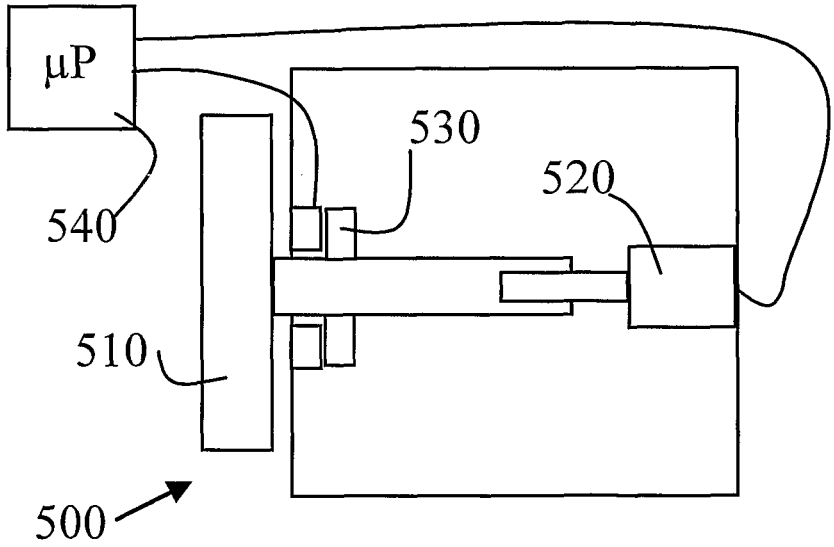
FIG. 6 schematically depicts a 2D cross-sectional view of a fourth control unit as can be applied in an illumination system according to the present invention.

FIG. 6 schematically discloses yet another embodiment of a control unit as can be applied in an illumination system according to the invention. The embodiment as shown comprises a control unit 500 comprising a control element 510 arranged to co-operate with a transducer 520. The arrangement as shown further comprises a sensor 530 for detecting the application of a pulling force on the control element 510. Such a sensor can e.g. be a force sensor or, as in general the application of a pulling force to the control element 510 will result in a, albeit small, displacement of the control element, a position sensor. Similar to the arrangement of the FIG. 5, an output signal of the force sensor or position sensor can be applied to determine for which purpose an output signal should be provided (either the first illumination parameter or the second illumination parameter). To enable this determination, an output signal of the force sensor or position sensor 530 can be provided to a microprocessor 540 together with an output signal of the transducer 520.

It can be noted that the microprocessor (or controller) as e.g. shown in FIGS. 5 and 6 can be incorporated in the control unit. As an alternative or in case the illumination system comprises multiple control units, the microprocessor can be separate from the control unit or units. In an arrangement of multiple control units, each control unit can e.g. provide an output signal corresponding to the changed characteristic (e.g. a characteristic of a transducer of the control unit) to a central microprocessor or controller. At the same time, the microprocessor or controller can be provided with an output signal of the detecting means (as described in FIG. 5) or the sensor (as described in FIG. 6). Based upon these signals, the microprocessor or controller can determine the operating state of each control unit and determine which illumination parameter needs adjusting. In a preferred embodiment the controller or microprocessor may control the control unit in such way that, after a predetermined period of time has lapsed since the control unit operates in the second state, the operating of the control unit automatically returns to an operation in the first operating state.

The control unit as applied in an illumination system according to the invention may further comprise indicating means for indicating an operating state of the control unit, such means may e.g. include a LED fixture. In a preferred embodiment the indicating means comprise a further light source (such as a LED fixture), the control unit being arranged to change an illumination parameter of the further light source in correspondence with a change of the first illumination parameter and/or the second illumination parameter of the light source. In such an arrangement, the status of the light source can be visually assessed via the status of the further light source. Such an arrangement may advantageously be applied when the light source cannot be seen from the position where the control unit is located.

Figure 7:
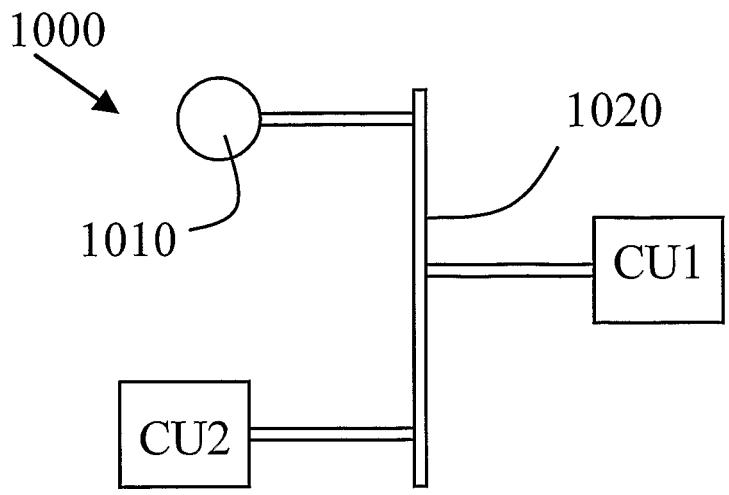
FIG. 7 schematically depicts an illumination control system according to an embodiment of the present invention.

FIG. 7 schematically depicts an illumination control system according to an embodiment of the present invention. The figure shows an embodiment of an illumination control system according to the present invention, the light control system 1000 comprising two control units (CU1, CU2) and a light source 1010. In the arrangement as shown, the control units CU1 and CU2 are connected via a communication interface, in the example, a common bus 1020, e.g. an RS485 bus. These connections can e.g. be applied to provide a control signal to the bus (master operation) or to receive a control signal (slave operation). Further examples of such a communication interface are a DALI or ZIGBEE interface. It can further be noted that the communication between the different control units can also be accomplished using a power line. In a similar way, the light source can retrieve the control signal from the communication interface. Each of the control units is arranged to operate in a first operating mode (also referred to as master-mode) wherein the control unit is arranged to e.g. generate a light source control signal and provide this signal to the other control unit or units in the system and is arranged to operate in second operating mode (also referred to as slave-mode) wherein the control unit is arranged to receive a light source control signal from the other control unit or units.

The operation of the light control system as shown in FIG. 7 can be understood as follows: when a control unit (e.g. CU1) is operated by a user, this user input action will put the control unit into master-mode; as a result, the control unit may generate a light source control signal to be sent to the light source and also to the other control unit (CU2). The light source control signal that is generated by the control unit can be based upon the user input action combined with a.o. a previously received light source control signal (assuming that prior to the user input action, control unit CU2 was acting as master, CU1 would have received the latest light source control signal that was sent to the light source). By doing so, a disruption or discontinuity of the light source control signal can be avoided.

In order to achieve this, the control unit that is being operated by the user needs to be aware of the latest control signal (or setpoint) in order to generate the appropriate new light source control signal: the user action input can (will in most cases) be an incremental signal (i.e. an increase in intensity or a change in colour). In order to avoid discontinuity of the light source control signal (which would be observed by the user), the incremental signal needs to be applied to the light source control signal in use prior to the generation of the new light source control signal. Upon generation of a new light source control signal, the control unit (CU1) that generated this signal can provide the signal to the light source and the other control units. The receipt of this light source control signal by the control unit that was providing the light source control signal prior to the user input action (CU2) can be used to switch the status of the control unit from master to slave as, by the user input action, CU1 has taken over the role as master. I.e. the receipt of a light source control signal by a control unit, can be considered to be a request to switch from master-role to slave-role. As an alternative to using the new light source control signal as a trigger to switch to slave-role, the control unit that has obtained the master-role (CU1) by a user input action may send a dedicated signal (a request) to the other control units (CU2), e.g. via the bussed network, to instruct the other control units to switch from master-mode to slave-mode.

In order to ensure a smooth transition from CU1 acting as master to CU2 acting as master, various scenario's are possible:

upon receipt of the dedicated signal or the new light source control signal, the control unit that was previously providing the control signal to the light source (CU1) may instantaneously switch to slave-mode. Once in slave-mode, the control unit CU1 no longer needs to provide the previous light source control signal to the other control units and the light source. (in this scenario, in case the switch from master to slave is triggered by the receipt of the dedicated signal, the transmission of the new light source control signal (by CU2) should already be ongoing when the dedicated signal is received to avoid discontinuity of the controlled characteristic of the light source.

upon receipt of the dedicated signal or the new control signal, the control unit that was previously providing the control signal (CU1) may continue for a few instances. In case the light source control signal comprises an array of setpoints (e.g. to control a number of fixtures or light sources), it may be preferred to let the previous control unit (CU1) finish providing this array of setpoints and start with the array after that.

In a preferred embodiment, the control unit that had the master-role prior to the application of a user input action to another control unit may, under certain conditions, maintain this master-role (i.e. refuse to switch from master to slave). Such a situation may occur in case two control units are operated by two different users almost at the same time. In such a situation it may be preferred that the control unit that was operated first remains in control. This can be arranged by making the switch from master to slave conditional. Such a condition may be that a master-role will at least be maintained for a certain period of time (e.g. 1 second). During this period, a request from another control unit will be disregarded. Preferably, the control unit disregarding the request may send a signal to the other control unit requesting the master-role. In such an arrangement, it may therefore be preferred that when a user input action is applied to a certain control unit, this control unit only receives the master status upon receipt of an acknowledgement signal from the previous master control unit, this signal e.g. being sent when the conditions for releasing the master-role are fulfilled.

Note that, as explained above, the light source control signal can be provided substantially continuously to the light source or only when a change to an illumination parameter of the light source is required.

Referring to FIG. 7, it will be appreciated by the skilled person that various options exist for organizing the communication between the different control units and the light source. As an alternative to organizing the communication by applying a RS485 or the like, one may consider to use a power line for communicating between the control units and the light source. The communication between the control units and the light source can also be established in a wireless manner e.g. by RF or IR communication. It will be clear to the skilled person that the described ways of communication can also be mixed. As an example, the communication between the control units can e.g. be established using a communication interface such as a RS485 interface or a power line whereas the communication between the control units and the light source is established using RF or IR communication.

As in the illumination control system according to the present invention, the master-role is not assigned to a dedicated control unit, this role may need to be assigned during start-up or initialisation of the control system. Such a start-up or initialisation of the system can occur in different forms:

- a start-up can be considered after the light source has been turned off by one of the control units and turned back on by the same control unit or by another control unit. In this case, one could opt to give the master-role (i.e. the role of providing the light source control signal) to the control unit that is used to turn the system back on. In case the system previously has been operational, each control unit has had access to the latest light source control signal and can be configured in such a manner that, when the control unit is turned on, the latest received control signal is applied by the control unit as the initial light source control signal for controlling the light source.
  - alternatively, when the system is turned on again, the master-role could be given to the control unit that had the master-role when the system was turned off. This scenario could e.g. be chosen when the on/off functionality of the control units is separate from the (incremental) control of e.g. the colour or intensity. In general, an on/off functionality can be organised separate from an actual control of an illumination parameter of the light source. As such, turning the light source off does not require a transfer of the master-role. In this situation, a possible start-up scenario could therefore be as follows:
  - a first control unit is used to change intensity and/or colour of a light source by generating a light source control signal and providing this signal to the light source and a second control unit.
  - subsequently, the light source is turned off by operating a switch of the first control unit.
  - subsequently, the second control unit is used to turn the light source back on, e.g. by operating a switch on the second control unit. As the master-role of the first control unit was not transferred due to the switch off of the light source, this control unit can continue as master and continue to provide the last generated light source control signal (or setpoint) to the light source. Only when the user uses the second control unit to adjust the colour and/or intensity a transfer of master role is required.

A start-up process could also be considered an initialisation i.e. a situation where prior to the start up, none of the control units has had the master role. In such a situation, a suitable strategy would be to assign the master role to the first control unit that is used by the user.

In order to establish a hierarchy between the different control units to assess which control unit has the master-role, it should be mentioned that this can be achieved in various ways. In order to establish which control unit has the master-role, a so-called 'flag' can be provided in each control unit (alternatively, a token can be passed between the control units); when the flag is set (1-state), the control unit has the master-role, when the flag is down (0-state), the control unit does not have the master-role. Initially, the flags of all control units can be set in the 0-state. In this situation, it may, in certain circumstances be required to define, to some extend, the light source behaviour; note that an initialisation, i.e. a start-up where, prior to the start-up all control units are in the 0-state, would constitute such circumstances. Often, it will be sufficient to ensure that, under such circumstances, the light source is extinct when no light source control signal is received (due to all control units being in the 0-state). Occasionally, e.g. when the control system is used to control an immergence illumination system, it may be required to define and configure the light source intensity and/or colour in the absence of a light source control signal. When the illumination system is powered on and all control units are in the 0-state, the light source will operate in the corresponding state e.g. extinct. Operating one of the control units (e.g. rotating a knob of the unit) by a user when the system is in this state, may trigger the flag of this control unit and put it in the 1-state. Simultaneously or in response to this trigger, the flags of the other control units can be set in the 0-state (during initialisation, the flags will already be in that state). As such, the control unit that is operated by the user obtains the master role. If subsequently, the user operates a second control unit, this operation can trigger the flag of this control unit to be put in the 1-state and subsequently or simultaneously trigger the flags of the other control units to be set in the 0-state.

Alternatively, a ranking can be maintained indicating for each control unit (each having a unique ID) its UID. During initialisation, each control unit could start up in a so-called discovery mode to detect other control units and check its own UID against the UID of the other control units to establish if the control unit has the master role or not. At some point, the user surfaces will have selected a master who resumes the control of the light source. The strategies may advantageously be applied in the following situation: rather than shutting the illumination control system down by using a switch that reduces the intensity of the light source to zero, the illumination control system can be shut down by disrupting the power supply to the system. This can e.g. be accomplished by a separate switch. As such, restarting the system by operating this switch may not be regarded by any of the control units as a user input action which triggers the control unit to obtain the master-role. However, also in this situation, it is preferred that the illumination control system is able to resume with the latest status of the illumination parameters. To enable this, the control units may, when the system has restarted, operate in a discovery mode to check which control unit is in a 1-state. This control unit may than obtain the master-role. A further complication may occur in case a control unit is removed from the system (either deliberately or due to a malfunction of the control unit) as in this case the control unit which previously had the master-role, may no longer be present in or be detected by the other part of the control system. In such case, it may be advantageous to have a hierarchy established between the control units such that under all conditions a control unit can be found that obtains the master-role. Establishing such a hierarchy can be achieved during operation based upon the sequence of user input actions to the various control units (the UID of each control unit can be used to maintain and update this hierarchy) such that operating in a discovery mode after a restart would always result in the master-role being assigned to one of the control units.

In order to control the light source, it will be appreciated by the skilled person that the control signal for controlling the light source can be presented to the light source in different forms. The control signal can e.g. comprise an 8-bit or 16-bit setpoint which can be retrieved by the light source from the bus connection (or is obtained directly via wireless (e.g. RF) transmission). The control signal can comprise an array of setpoints. A first setpoint can e.g. be used to control the intensity of the light source whereas a second setpoint of the array is used to control the colour of the light source.

In a preferred embodiment, the illumination control system is applied to control a LED fixture as a light source. Such a LED fixture can e.g. comprise a red LED, a green LED and a blue LED. Optionally, the led fixture also comprises a white LED. The colour of the LED fixture can be modified by applying a different duty-cycle for the different LEDs. The different duty-cycle can be obtained by a PWM controller. Alternatively, in a preferred embodiment of the present invention, a control schedule as described in WO 2006/107199 can be applied to control the LED fixture.

In order to demonstrate the capabilities of the light source and the illumination control system, the light source control signal may e.g. comprise an array of setpoints witch result in a light show being executed by the light source. Such light show may e.g. demonstrate the capabilities of the light source with respect to intensity, colour range, ways to direct a beam of the light source, etc. . . . In order to execute the required light show, it may be sufficient to provide the light source with a number of parameters describing the required light show. In this case, the light source control signal may comprise a number of parameters e.g. describing initial and end values of colour or intensity and describing the timing of the light show such as starting, stopping, resetting the light show. In such situation, the light source may comprise a controller (or microprocessor) arranged to generate, based upon the number of parameters the required setpoints (or trajectory of the different illumination parameters) for the light source. Such a controller may also be referred to as a trajectory generator or a show generator. In general, the conversion from a number of parameters to the required setpoints describing a trajectory to be followed for the various illumination parameters can e.g. be done using known interpolation techniques such as linear or spline functions. As will be clear from the above, the illumination control system according to the present invention may advantageously be applied to perform a light show. As the present illumination control system allows a flexible control by two or more control units, the execution of such a light show can be controlled by the different control units since the light source control signal is made available to each control unit. In a preferred embodiment, each control unit of the illumination control system is arranged to store one or more light shows (either as an array of setpoints to be provided consecutively to the light source or defined by a number of parameters). As such, the parameters of the light show that is being executed can be modified from the different control units (such modifications may e.g. include the acceleration of the show, changing the overall intensity, . . . ).

Figure 8:
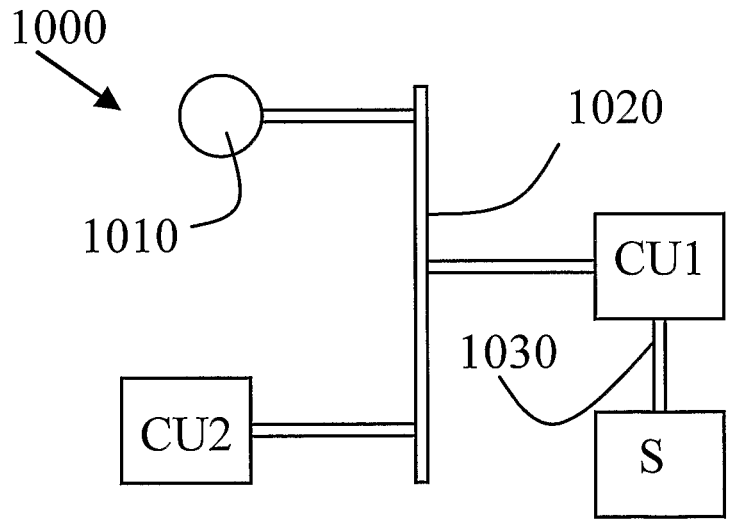
FIG. 8 schematically depicts an illumination system according to a second embodiment of the invention.
Figure 9:
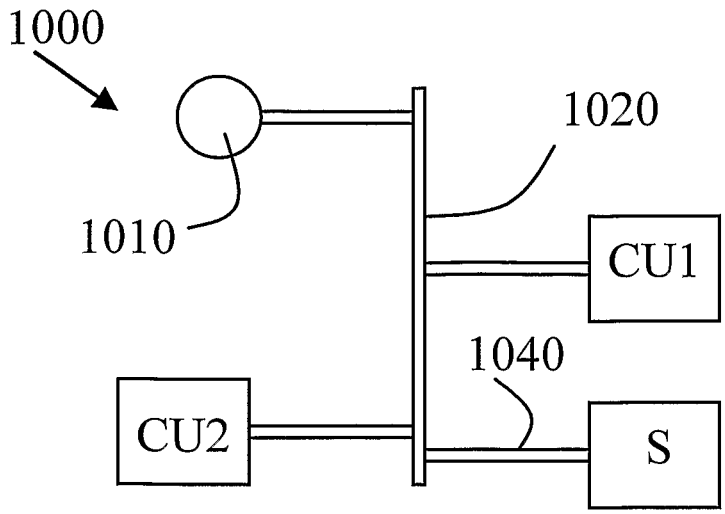
FIG. 9 schematically depicts an illumination system according to a third embodiment of the invention.

FIGS. 8 and 9 schematically depict further embodiments of the lighting control system according to the invention. The various ways of operating the lighting control system schematically depicted in FIG. 7 may equally be applied in the lighting control systems schematically depicted in FIGS. 8 and 9. Compared to the lighting control system of FIG. 7, the lighting control systems depicted in FIGS. 8 and 9 are arranged to receive a sensor signal from a sensor S. Such a sensor signal may e.g. indicate the occurrence of an event such as the occurrence of a hazardous situation (e.g. a fire) or the occurrence of an environmental change (outdoor brightness dropping below a certain level).

FIG. 8 schematically depicts the lighting control system as shown in FIG. 7 (indicated by the same reference numbers as used in FIG. 7) whereby control unit CU1 is arranged to receive a sensor signal from a sensor S. In the arrangement as shown, the sensor signal, which can be provided to the control unit CU1 via a communication interface 1030 is only received by CU1. Upon receipt of the sensor signal, the control unit CU1 that is receiving the sensor signal can then resume or start to operate in the first operating mode, thereby obtaining or continuing the master-role. Further, in response to the receipt of the sensor signal, the control unit can provide a signal or a request to the other control unit CU2 to operate in the second operating mode. The control unit CU1 receiving the sensor signal may then generate a light source control signal based on the sensor signal and provide the light source control signal to the light source to operate the light source in accordance with the sensor signal. In case the arrangement as schematically depicted in FIG. 8 is such that only CU1 can receive the sensor signal, no actual pairing of the sensor S and the CU1 is required. It may however occur that the signal as received by CU1 is also received by CU2 (CU1 can e.g. be arranged to provide the sensor signal via the communication interface 1020 to the second control unit CU2). In such case, one may, by application of a pairing algorithm or protocol, enable that only one of the control units CU1, CU2 responds to the sensor signal.

FIG. 9 schematically depicts a further embodiment of the lighting control system corresponding to the lighting control system as shown in FIG. 7 (indicated by the same reference numbers as used in FIG. 7) whereby control units CU1 and CU2 are arranged to receive a sensor signal from a sensor S, which is schematically indicated in FIG. 9 by the communication interface 1040 connecting the sensor S to the communication interface 1020 connecting the control units CU1 and CU2. In such an arrangement, the control units can be arranged to respond to the sensor signal only when they operate in the first operating mode. By doing so, only the control unit having the master role needs to generate the light source control signal based on the sensor signal. Note that in such an arrangement, there is no need for any of the control units receiving the sensor signal to provide a signal or a request to the other control units to operate in the second operating mode as there is no requirement to change the role (either master or slave) of any of the control units. As mentioned above, a sensor signal may e.g. indicate the occurrence of an event. The sensor signal may further comprise a qualification with respect to the urgency of the event that resulted in the sensor signal. It is worth noting that a control may respond differently to a sensor signal based on the urgency comprised in the signal. Based upon the urgency level (e.g. an alarm level) comprised in the sensor signal, a different light source control signal can be generated by the control unit responding to the sensor signal.

It should further be emphasised that any of the control units of the illumination system according to the invention, may advantageously be applied as control units in the illumination control system according to the invention.

It can further be noted that, in general, the control units as applied in the illumination system according to the invention or as applied in the illumination control system according to the invention can be mounted to a wall or a panel. Alternatively, they may also take the form of a wireless remote control unit.

The invention claimed is:

1. An illumination control system comprising a light source and a first and second control unit for controlling an illumination parameter of the light source, each control unit being arranged to, when in a first operating mode, generate a light source control signal, provide the light source control signal to the light source, provide the light source control signal to the other of the first and second control unit, each control unit further being arranged to, when in a second operating mode, receive and store the light source control signal generated by the other of the first and second control unit, each control unit further being arranged to, upon application of a user action to the control unit, resume or start to operate in the first operating mode, provide a signal or a request to the other of the first and second control unit to operate in the second operating mode.

2. The illumination control system according to claim 1 wherein the first and second control unit are arranged to receive a sensor signal, generate the light source control signal based on the sensor signal when operating in the first operating mode, provide the light source control signal to the light source.

3. The illumination control system according to claim 1 wherein one of the first and second control unit is arranged to, upon receipt of a sensor signal, resume or start to operate in the first operating mode, provide a signal or a request to the other of the first and second control unit to operate in the second operating mode, generate the light source control signal based on the sensor signal, provide the light source control signal to the light source.

4. The illumination control system according to claim 1 wherein the generation of the light source control signal is based on both the user action and a previously stored light source control signal.

5. The illumination control system according to claim 1 wherein the light source control signal is substantially continuously provided to the light source.

6. The illumination control system according to claim 1 wherein the signal or the request comprises the light source control signal.

7. The illumination control system according to claim 1 wherein the first and second control units are connected via a communication interface.

8. The illumination control system according to claim 7 wherein the light source is connected to the control units via the communication interface.

9. The illumination control system according to claim 7 wherein the communication interface comprises a RS485 bus or a power line.

10. The illumination control system according to claim 7 wherein the illumination control system is arranged to provide the light source control signal to the light source via RF or IR communication.

11. The illumination control system according to claim 1 wherein the light source comprises one or more LED fixtures.

12. The illumination control system according to claim 1 wherein the light source control signal comprises an array of set points for controlling the light source illumination parameter or a parameter set describing a light show.

13. The illumination control system according to claim 1 wherein the illumination parameter comprises an intensity of the light source or a colour of the light source.

14. The illumination control system according to claim 13 wherein the light source comprises a controller for receiving the light source control signal and converting the light source control signal to an input signal for the one or more LED fixtures.

15. The illumination control system according to claim 14 wherein the controller is further arranged to store the light source control signal and apply the light source control signal to control the light source until a further light source control signal is received.

16. The illumination control system according to claim 14 wherein the input signal comprises a PWM signal.

17. The illumination system according to claim 1 wherein each control unit is further arranged to operate in the first operating mode only upon receipt of an acknowledgement signal.

* * * * *